United States Patent [19]

Brehm et al.

[11] Patent Number: 4,900,363

[45] Date of Patent: Feb. 13, 1990

[54] METHOD AND LIQUID PREPARATION FOR REMOVING RESIDUES OF AUXILIARY SAWING MATERIALS FROM WAFERS

[75] Inventors: Gerhard Brehm, Emmerting; Manuela Knipf, Burghausen; Rudolf Mayrhuber, Ostermiething; Jürgen Schuhmacher; Max Stadler, both of Haiming, all of Fed. Rep. of Germany

[73] Assignee: Wacker-Chemitronic Gesellschaft fur Elektronik-Grundstoffe m.b.H., Burghausen, Fed. Rep. of Germany

[21] Appl. No.: 173,259

[22] Filed: Mar. 25, 1988

[30] Foreign Application Priority Data

Apr. 3, 1987 [DE] Fed. Rep. of Germany ..... 3711262

[51] Int. Cl.[4] ..... B08B 3/08

[52] U.S. Cl. ..... 134/3; 134/41

[58] Field of Search ..... 134/3, 41

[56] References Cited

U.S. PATENT DOCUMENTS 3,607,397 9/1971 Watters et al. ..... 134/41

4,508,641 4/1985 Hanulek ..... 134/3

OTHER PUBLICATIONS

Aldrich Catalogue, p. 764 (1988–89).

Valtron AD 1210 Ingot Mounting Adhesive, Bulletin No.: AD–6.

*Primary Examiner*—Asok Pal

*Attorney, Agent, or Firm*—Collard, Roe & Galgano

[57] ABSTRACT

A process and liquid preparation is disclosed for removing residues from wafers sawn from crystalline rods. In sawing rod-shaped workpieces such as semiconductor rods, for example, into wafers, by means of an internal-hole saw, auxiliary sawing materials such as for example cutting strips are often attached to the rods. According to the present invention, the residues of such auxiliary sawing materials remaining on the wafers obtained after the sawing operation can be removed particularly easily by means of immersion in baths of aqueous carboxylic solutions and, in particular, aqueous formic acid.

16 Claims, No Drawings

METHOD AND LIQUID PREPARATION FOR REMOVING RESIDUES OF AUXILIARY SAWING MATERIALS FROM WAFERS

BACKGROUND OF THE INVENTION

1. Field of the Invention

The invention relates to a method and a liquid preparation for removing residues of auxiliary sawing materials from thin wafers which are obtained by sawing up rod-shaped workpieces, in particular, crystalline rods.

2. Description of the Prior Art

It is known to saw rod-shaped workpieces, especially crystalline rods, composed, for instance, of oxidic materials, such as glass, quartz, gallium gadolinium garnet, sapphire, spinel or composed of semiconductor material such as silicon, germanium, gallium arsenide or indium phosphide into thin wafers. In this connection, the satisfactory separation of the wafers from the workpiece is often assisted by auxiliary sawing materials, for instance, as taught by German Auslegeschrift No. 106 628 (U.S. Pat. No. 3,078,549), by encasing the workpiece in a synthetic-resin sheath composed of epoxy resin. According to the German Offenlegungsschrift No. 3,010,866, separation can also be assisted by cementing several rods together by means of synthetic resin to form a bundle of rods, or, according to German Offenlegungsschrift No. 3,216,200 (U.S. Pat. No. 4,513,544), by cementing the workpiece onto a cutting strip with suitable adhesives, the cutting strip being composed, for example, of graphite or ceramic material, and holding the wafers separated in a multiple internal-hole sawing method. Similar cutting strips are also used in internal-hole sawing with single-wheel systems, especially if the wafers or groups of wafers have to be completely separated in the sawing operation and removed by means of removal devices.

Before further processing of the wafers, such as lapping or polishing, the residues of such auxiliary sawing materials have to be removed. For this purpose, in the prior art discussed above, the wafers are introduced into a trichloroethylene or acetone bath in which the surrounding ring of synthetic resin begins to swell and detach itself. In a similar manner, the residues of the cutting strips which are, as a rule, secured by means of epoxy resin adhesives to the wafers, usually are removed by introduction into a trichloroethylene bath.

It has long been known that many problems are connected with the use of organic solvents such as trichloroethylene or acetone. In this connection, an important aspect of the process is the health risks to the operating personnel which can stem from such use of solvents. These risks require that usually expensive safety precautions be taken and exhaust systems utilized, especially as the baths are operated, as a rule, at elevated temperatures in the vicinity of the boiling point in order to achieve a rapid removal. Moreover, the disposal of such solvents is difficult. Used trichloroethylene is, for instance, not biodegradable and, therefore, has to be disposed of by combustion, for example. In many cases, the fire hazard and the low flashpoint of some organic solvents must also be borne in mind.

SUMMARY OF THE INVENTION

The object of the invention is to provide a process and apparatus for removing the residues of auxiliary sawing materials from wafers which is comparable to or more effective than the use of organic solvents but without the disadvantages of the latter.

Accordingly, this object is achieved by a process wherein the wafers are brought into contact with an aqueous solution of one or more carboxylic acids containing 1 to 6 carbon atoms, and kept in contact with the latter until the bond between wafer and the residue of auxiliary sawing material is separated.

Mono- and also di- or tricarboxylic acids are suitable as carboxylic acids. Examples of such suitable acids are formic acid, acetic acid, propionic acid, adipic acid or citric acid, the mono-carboxylic acids containing 1 to 3 carbon atoms having proved especially successful. Preferably, formic acid is used which has proved particularly effective compared with the other acids.

The acids selected in each case can be provided as aqueous solutions in a wide range of concentrations, both individually and also as a mixture. In principle, with the use of carboxylic acids, which are liquid at the selected working temperatures such as formic or acetic acid, even the use of highly concentrated solutions with acid proportions of about 98–99% by weight are not ruled out. However, even in this instance, the proportion of acid in the solution is kept lower because of the strong irritation due to smell, the increased ignition risk and the increased expense. Thus, aqueous solutions with a proportion of acid ranging from 0.5 to 70% by weight, but preferably 5 to 50% by weight, are therefore generally used. In general, for the concentration eventually used, a shorter exposure time is necessary with increasing concentration, but this is balanced against the increased material requirements and increased cost of the apparatus. In most cases, these parameters can be determined on the basis of preliminary trials and can be matched to each other.

The exposure time to the aqueous carboxylic acid solution selected as necessary to remove the auxiliary sawing material from the wafers can also be affected by the temperature. It is expedient to use the solutions at 20° to 100° C., and more advantageously, at 60° to 95° C. Increased temperatures result in shortened exposure times. Above this limit, however, the losses due to solution evaporation can no longer be tolerated, while at temperatures below 20° C. the effectiveness markedly declines.

Other objects and features of the present invention will become apparent from the following detailed description of the preferred embodiments.

DETAILED DESCRIPTION OF THE PREFERRED EMOBODIMENTS

According to one embodiment of the invention, inorganic acids which do not attack the wafers to be treated and whose $pK_a$ value is lower than that of the carboxylic acid or carboxylic acid mixture present may also be added to the selected solution. In the case of the preferred aqueous formic acid ($pK_a$ approximately 3.7) and for silicon or germanium wafers, for instance, hydrochloric acid, hydrobromic acid, hydroiodic acid, phosphoric acid or sulfuric acid are accordingly suitable. It is necessary, of course, to bear in mind the possible contamination of the wafers with dopants. Generally, it is sufficient to add the inorganic acid selected in a particular case in a concentration of up to 5% by weight referred to the total solution.

In another embodiment, up to approximately 10% by weight, preferably up to 5% by weight, of substances which have surfactant properties, for instance alkylsulfonates, alkylarylsulfonates, salts of long-chain carboxylic acids or ethylene oxide adducts, are added to the aqueous carboxylic acid solution, additionally or alternatively to the inorganic acids. Such solutions make it possible to achieve cleaning of the wafer surface simultaneously with the removal of the auxiliary sawing material.

Expediently, the aqueous carboxylic acid solutions, in particular formic acid solutions, optionally provided with the additives mentioned, are provided in the form of one or more baths which are arranged behind each other in series. It has been found advantageous to heat these baths and the wafers to be treated may be immersed, optionally consecutively, and left until the residues of the auxiliary sawing materials are removed. At the same time, a relative movement can be carried out between the wafers and the medium contained in the bath, either by moving the wafers or by circulating the bath liquid. Another possible alternative for bringing the wafers into contact with the aqueuous carboxylic acid solution is to arrange for them to be sprayed or exposed to a jet of liquid directly in the region of the point of separation envisaged.

The use of one or more baths has the advantage that the wafers can be made ready in the usual processing boats which are commonly used for surface cleaning processes. At the same time, however, it should be borne in mind that these boats which are capable, as a rule, of accepting batches of 25 wafers, are manufactured from materials resistant to the medium provided in the bath. Such suitable materials are plastics such as polytetrafluoroethylene or polypropylene. Also the use of metallic materials, such as stainless steel, is not ruled out, but involves the risk of undesirable contamination of the wafer surface in the treatment of wafers composed of semiconductor material. It is expedient to manufacture at least the inside walls of the containers receiving the aqueous solutions used from such resistant materials to avoid contamination.

As a result of the exposure to selected aqueous carboxylic acid solutions, the bond between the wafer edge and the residue of the auxiliary sawing material (which is, as a rule, based on the adhesive action of adhesives) is gradually made weaker until it is completely severed and the residue of the auxiliary sawing material is separated from the wafer. The process according to the present invention is especially suitable for use in the case where bonds to the auxiliary sawing agent are produced by means of thermosetting adhesives based on epoxy resin, phenolic resin, acrylate resin, cyano acrylate or polyester resin formulations, in which cases it is optionally also possible for the cured adhesive itself to be the auxiliary sawing material. Typical examples are, for instance, the division of crystalline rods composed of semiconductor or oxide material into wafers by means of an internal-hole saw. In this case, prior to sawing, the rods are cemented onto a cutting strip composed of, for instance, ceramic material, glass or carbon, usually by means of an epoxy resin adhesive, and initially cured in the holder.

When gang sawing is used to cut blocks of coarse crystalline silicon for solar cells, auxiliary sawing materials such as glass prisms are also frequently cemented onto the blocks and their residues then initially remain attached to the wafers obtained. Moreoever, mention may be made of the division of optical material such as glass into wafers, during which division the sawing operation is frequently assisted by the mounting of cutting strips on the workpieces. Obviously, the examples mentioned herein are not meant as limitations on the invention.

Aqueous carboxylic acid solutions, especially those based on formic acid, used according to the invention to remove the residues of auxiliary sawing material from the wafers, exhibit an approximately equal or higher effectiveness compared with the organic solvents commonly used, such as trichloroethylene or acetone. In addition, these solutions have the advantage of a substantially reduced or negligible risk of ignition and a markedly lower safety hazard for the operating personnel. Moreover, the disposal presents fewer problems since the solutions mentioned are, as a rule, biodegradable.

The invention will now be explained more fully in the following examples which are, however, only given by way of illustration and not of limitation.

EXAMPLE 1

A silicon rod (diameter approximately 10 cm., length approximately 100 cm.) obtained by pulling from a crystal by the Czochralski technique was sawn into wafers approximately 400 μm thick by means of a commercially available internal-hole saw. To assist the sawing operation, an epoxy resin-based adhesive marketed under the trademark "Araldite" was used to cement the rod onto a graphite cutting strip (cross-section approximately $12\times25$ mm$^2$) which was also used as an aid for mounting the rod and for preventing chipping in the final phase of each cut. In this case, a residual cut of the cutting strip was left at the outside circumference of each wafer separated. In total, one hundred twenty (120) wafers were sawn.

To remove the adhering residual cuts, ten of these wafers were immersed in a bath filled with a suitable medium for this purpose and left until all the residual cuts separated themselves from the wafers. At the same time, the duration of exposure between immersion and detachment of the residue of the cutting strip was measured for each individual wafer and eventually the mean was taken of this value for all ten wafers. In this process, aqueous solutions of formic acid, acetic acid, propionic acid, adipic acid and citric acid in various concentrations were provided as bath liquid at a temperature of approximately 90° C. As a comparison, 10 wafers were also treated in a bath kept at the boiling point (approximately 87° C.) by a heater and filled with trichloroethylene. The results obtained under these circumstances are compared in the following table.

TABLE

Exposure time required to separate the residue of the cutting strip from silicon wafers 400 μm thick in various bath liquids.

| Bath Liquid | Proportion of acid (% by weight) | Bath Temperature (°C.) | Exposure Time (in mins.) |
|---|---|---|---|
| Formic acid/ | 30 | 90 | 0.25 |
| water | 15 | 90 | 0.38 |
| | 5 | 90 | 0.75 |
| Acetic acid/ | 50 | 90 | 0.33 |
| water | 30 | 90 | 0.75 |
| | 15 | 90 | 1.25 |
| Propionic acid water | 5 | 90 | 3.0 |
| Citric acid/ water | 50 | 90 | 6.5 |
| Adipic acid/ water | 50 | 90 | 4 |
| Trichloro- | — | 87 | 3.2 |

TABLE-continued

| Exposure time required to separate the residue of the cutting strip from silicon wafers 400 μm thick in various bath liquids. | | | |
|---|---|---|---|
| Bath Liquid | Proportion of acid (% by weight) | Bath Temperature (°C.) | Exposure Time (in mins.) |
| ethylene, 100% | | | |

EXAMPLE 2

Ten (10) of the wafers sawn in accordance with Example 1 were introduced into each of three baths held at room temperature (approximately 25° C.). A solution containing 50 percent by weight of formic acid was used as the bath liquid in the first bath. A solution containing 50 percent by weight of acetic acid was used in the second bath and trichloroethylene in the third bath. All the residual cuts were separated from the wafers as early as within approximately one hour after immersion in the formic acid bath. In the acetic acid bath, separation occurred after approximately three hours, and in the trichloroethylene bath only after approximately 10 hours.

EXAMPLE 3

Two baths containing a 15% by weight solution of formic acid (bath temperature 65° C. in each case) were provided. In one of the baths, approximately 2% by weight of a commercially obtainable surfactant based on alkylsulfonate was added to the bath liquid. In each bath were placed 10 silicon wafers, each superficially contaminated with severe striations of abraded saw material. These baths were continuously kept in synchronous motion for approximately one minute.

After this treatment, the residual cuts of the cutting strip had detached themselves in both groups. No striations could any longer be detected visually on the surface of the wafers treated in the bath containing surfactants, whereas the wafers treated in the bath which was surfactant-free still exhibited striations on the wafer surface.

While several examples and embodiments of the present invention have been described, it is obvious that many changes and modifications may be made thereunto, without departing from the spirit and scope of the invention.

What is claimed is:

1. A process for removing a residue of auxiliary sawing materials from wafers which are obtained by sawing rod-shaped workpieces, in particular, crystalline rods, comprising the step of:

bringing the wafers having the residue of the auxiliary sawing material adhesively bonded to the wafer edge into contact with an aqueous solution of one or more carboxylic acids containing two to six carbon atoms, wherein formic acid is included as one of said carboxylic acids, and keeping the wafers in contact with said aqueous solution of one or more carboxylic acids until the bond between the wafers and the residue of the auxiliary sawing material is separated.

2. The process as set forth in claim 1, wherein a monocarboxylic acid, in addition to formic acid, containing two to three carbon atoms, is included as said carboxylic acids.

3. The process as set forth in claim 1, wherein the proportion of said carboxylic acids in said aqueous solution is adjusted to 0.5 to 70% by weight.

4. The process as set foth in claim 1, wherein said aqueous solution is provided as a bath.

5. The process as set forth in claim 4, wherein said bath is kept at a temperature of 20°–100° C.

6. The process as set forth in claim 4, wherein said bath is kept at a temperature of 60°–95° C.

7. The method as set forth in claim 1, further including the step of adding to said aqueous solutions a member selected from the group consisting of up to 10% by weight of surfactants, up to 5% by weight of an inorganic acid whose $pK_a$ value is lower than that of the carboxylic acid provided and which does not attack the wafers and a combination thereof.

8. The process as set forth in claim 1, wherein acetic acid is included as one of said caboxylic acids.

9. A process for removing a residue of auxiliary sawing materials from wafers which are obtained by sawing rod-shaped workpieces, in particular, crystalline rods, comprising the step of:

bringing the wafers having the residue of the auxiliary sawing material adhesively bonded to the wafer edge into contact with an aqueous solution of formic acid and keeping the wafers in contact with the aqueous solution of formic acid until the bond between the wafers and the residue of the auxiliary sawing material is separated.

10. The process as set forth in claim 9, wherein the aqueous solution of formic acid further includes at least one monocarboxylic acid, in addition to formic acid, containing two to three carbon atoms.

11. The process as set forth in claim 10, wherein the additional monocarboxylic acid in the aqueous solution is acetic acid.

12. The process as set forth in claim 9, wherein the proportion of the formic acid in said aqueous solution is adjusted to 0.5 to 70% by weight.

13. The process as set forth in claim 9, wherein said aqueous solution is provided as a bath.

14. The process as set forth in claim 13, wherein said bath is kept at a temperature of 20°–100° C.

15. The process as set forth in claim 14, wherein said bath is kept at a temperature of 60°–95° C.

16. The process as set forth in claim 9, further including the step of adding to said aqueous solutions a member selected from the group consisting of up to 10% by weight of surfactants, up to 5% by weights of an inorganic acid whose $pK_a$ value is lower than that of the carboxylic acid provided and which does not attack the wafers and a combination thereof.

* * * * *